US009183802B2

(12) United States Patent
Tang et al.

(10) Patent No.: US 9,183,802 B2
(45) Date of Patent: Nov. 10, 2015

(54) DISPLAYER AND PIXEL CIRCUIT THEREOF

(75) Inventors: Lung-Ling Tang, Hsinchu (TW); Wei-Kai Huang, Hsinchu (TW)

(73) Assignee: AU OPTRONICS CORP., Hsinchu (TW)

( * ) Notice: Subject to any disclaimer, the term of this patent is extended or adjusted under 35 U.S.C. 154(b) by 681 days.

(21) Appl. No.: 13/228,503

(22) Filed: Sep. 9, 2011

(65) Prior Publication Data

US 2012/0120130 A1 May 17, 2012

(30) Foreign Application Priority Data

Nov. 15, 2010 (TW) ..... 99139175 A

(51) Int. Cl.
*G09G 3/36* (2006.01)

(52) U.S. Cl.
CPC ..... *G09G 3/3648* (2013.01); *G09G 3/3614* (2013.01); *G09G 2300/0447* (2013.01)

(58) Field of Classification Search
CPC . G09G 3/2077; G09G 3/2085; G09G 3/3607; G09G 3/3659
See application file for complete search history.

(56) References Cited

U.S. PATENT DOCUMENTS

| | | | | |
|---|---|---|---|---|
| 7,986,296 | B2 | 7/2011 | Cheng | |
| 2004/0189575 | A1* | 9/2004 | Choi et al. | 345/96 |
| 2006/0139281 | A1* | 6/2006 | Park | 345/96 |
| 2007/0008274 | A1* | 1/2007 | Nakanishi et al. | 345/101 |
| 2008/0210940 | A1* | 9/2008 | Lee et al. | 257/59 |
| 2008/0246720 | A1* | 10/2008 | Lee et al. | 345/96 |
| 2009/0027325 | A1* | 1/2009 | Kim et al. | 345/92 |
| 2009/0322659 | A1* | 12/2009 | Chan et al. | 345/87 |
| 2010/0134482 | A1 | 6/2010 | Ogura et al. | |
| 2010/0201903 | A1* | 8/2010 | Huang et al. | 349/55 |

FOREIGN PATENT DOCUMENTS

| | | |
|---|---|---|
| CN | 1619400 A | 5/2005 |
| CN | 1773601 | 5/2006 |
| CN | 101236971 | 8/2008 |
| CN | 101387770 | 3/2009 |
| TW | 201030710 A1 | 8/2010 |

OTHER PUBLICATIONS

Chinese Office Action dated Nov. 29, 2012.
Taiwan Office Action dated Jul. 22, 2013.
English translation of abstract and pertinent parts of CN 1773601.
English translation of abstract and pertinent parts of CN 101387770.
Chinese Office Action dated Feb. 29, 2012.

* cited by examiner

*Primary Examiner* — Alexander Eisen
*Assistant Examiner* — Mark Regn
(74) *Attorney, Agent, or Firm* — WPAT, PC; Justin King

(57) ABSTRACT

A displayer and a pixel circuit thereof are provided. The displayer comprises the pixel circuit and a driving circuit for supplying a driving voltage to the pixel circuit. The pixel circuit belongs to a two data lines and one gate line architecture and comprises two pixel electrodes at least. The two pixel electrodes belong to the same pixel type and are positioned adjacent to each other. Thereby, the pixel circuit can improve the color shift effectively.

5 Claims, 4 Drawing Sheets

DISPLAYER AND PIXEL CIRCUIT THEREOF

This application claims priority to Taiwan Patent Application No. 099139175 filed on Nov. 15, 2010, which is hereby incorporated by reference in its entirety.

CROSS-REFERENCES TO RELATED APPLICATIONS

Not applicable.

BACKGROUND OF THE INVENTION

1. Field of the Invention

The present invention relates to a displayer and a pixel circuit thereof. More particularly, the present invention relates to a displayer and a pixel circuit thereof, in which two pixel electrodes belongs to a same pixel type and be disposed adjacent to each other.

2. Descriptions of the Related Art

As liquid crystal displayers (LCDs) are continuously developing towards large-sized ones, continuous progress also needs to be made in wide viewing angle technologies of LCD panels in order to overcome the problem about the viewing angle with large-sized displayers. Currently, multi-domain vertical alignment (MVA) LCD panels and polymer stabilized alignment (PSA) LCD panels are among the wide viewing angle technologies that are commonly used.

To improve the color shift in the LCD panels, a kind of advanced-MVA LCD panel has been proposed. In the advanced-MVA LCD panel, each of pixels is divided into a main display region (i.e., a main-pixel) and a sub-display region (i.e., a sub-pixel); and through a proper circuit design and a proper driving method, the main-pixel and the sub-pixel in the same pixel are provided with different voltages respectively to improve the color shift. Accordingly, designs in which a single pixel region has two data lines and one scan line (also referred to as a gate line) or in which a single pixel region has one data line and two scan lines are introduced, which are called as the 2G1D structure and the 2D1G structure respectively. Taking the 2D1G structure as an example, a pixel region comprises two sub-pixels, which are controlled by different data lines respectively.

Furthermore, referring to FIG. 1, a schematic view of a pixel circuit is shown therein. Generally speaking, there are two kinds of different electrical connection structures between the aforesaid MVA LCD and the data lines, i.e., positive (P) pixel electrodes and negative (N) pixel electrodes. The two kinds of pixel electrodes are staggered in the pixel circuit in a PNPNPN or NPNPNP pattern. However, this staggered pattern is prone to cause color shift in an image generated by the pixel circuit when a specific frame is displayed, thus degrading the displaying quality of the LCD.

Specifically, among pixel electrodes in FIG. 1, R represents a red pixel electrode, G represents a green pixel electrode, B represents a blue pixel electrode, a white background represents that the corresponding pixel displays a bright state, and a black background represents that the corresponding pixel displays a dark state. As can be known from FIG. 1, when a frame is displayed and the R pixel electrodes, the G pixel electrodes and the B pixel electrodes are all in the bright state or all in the dark state simultaneously, the color shift phenomenon will occur. Taking the arrangement of the pixel electrodes in FIG. 1 as an example, when a frame of a checkerboard pattern is displayed, the green main-pixels in the main-pixel rows A, B, C are all positive.

In detail, referring to FIG. 2, there is shown a schematic view depicting that a common electrode signal is pulled away from an original direct current (DC) level by a data line signal with the positive and negative polarities. When the data line signal (Vdata) has a transient, the common electrode voltage (VCOM) at the pixel array side is pulled by Vdata to result in the waveform as shown in FIG. 2. When the potential of the data line signal rises, the VCOM will be raised; otherwise, when the potential of the data line signal falls, the VCOM will be dropped. Therefore, when the data lines are driven in the column inversion manner, in one main-pixel rows A, B, C, the green main-pixels are all of the positive polarity and the red main-pixels and the blue main-pixels are all of the negative polarity. Thereby, the VCOM signal is pulled towards the polarity direction of the red (or blue) main-pixels. Therefore, in the frame displayed, the green color has a gray scale higher than the originally defined level while the other two colors have gray scales lower than the originally defined levels. This causes the aforesaid color shift (bias to the green color) phenomenon. Furthermore, when arrangement of the pixels of different colors in the pixel electrodes are altered, different color shift phenomena will be caused.

Accordingly, an urgent need exists in the art to effectively prevent occurrence of the color shift phenomenon in an image generated by the pixel circuit so as to improve the displaying quality of the LCD and increase the added value of this industry.

SUMMARY OF THE INVENTION

An objective of the present invention is to provide a pixel circuit belonging to a two data lines and one gate line (2D1G) architecture and used for a displayer. The displayer comprises a driving circuit electrically connected to the pixel circuit and configured to provide a driving voltage to the pixel circuit. The pixel circuit can improve the color shift of a display frame effectively through specific arrangement of pixel electrodes.

To achieve the aforesaid objective, the pixel circuit comprises a data line set, a first pixel electrode and a second pixel electrode. The data line set is electrically connected to the driving circuit. The first pixel electrode is electrically connected to the data line set, and configured to receive the driving voltage through the data line set while the first pixel electrode is in a conducting state. The second pixel electrode belongs to a same pixel type as the first pixel electrode, and is disposed adjacent to the first pixel electrode. The second pixel electrode is further electrically connected to the data line set, and configured to receive the driving voltage through the data line set while the second pixel electrode is in the conducting state.

Additionally, to achieve the aforesaid objective, the displayer comprises a plurality of pixel electrodes, a first polarity data line and a second polarity data line. The first polarity data line is electrically connected to each of the pixel electrodes. The second polarity data line is electrically connected to each of the pixel electrodes. Main-pixels of at least two adjacent pixel electrodes of the pixel electrodes are electrically connected to the first polarity data line respectively, and sub-pixels of at least two adjacent pixel electrodes of the pixel electrodes are electrically connected to the second polarity data line respectively.

According to the above descriptions, in the present invention, two pixel electrodes belonging to a same pixel type are disposed adjacent to each other. Thereby, during waveform transformation of the driving voltage, a common electrode signal can be effectively prevented from being pulled towards the same polarity directions as the waveform transformation so that the three colors (i.e., a red color, a green color and a blue color) in the display can conform to the gray scales that are originally defined. This can reduce the color shift of a specific display frame and increase the added value of this industry.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following description, the present invention will be explained with reference to embodiments thereof. However, these embodiments are not intended to limit the present invention to any specific environment, applications or particular implementations described in these embodiments. Therefore, description of these embodiments is only for purpose of illustration rather than to limit the present invention. It should be appreciated that, in the following embodiments and the attached drawings, elements not directly related to the present invention are omitted from depiction; and dimensional relationships among individual elements in the attached drawings are illustrated only for ease of understanding but not to limit the actual scale.

Figure 1:
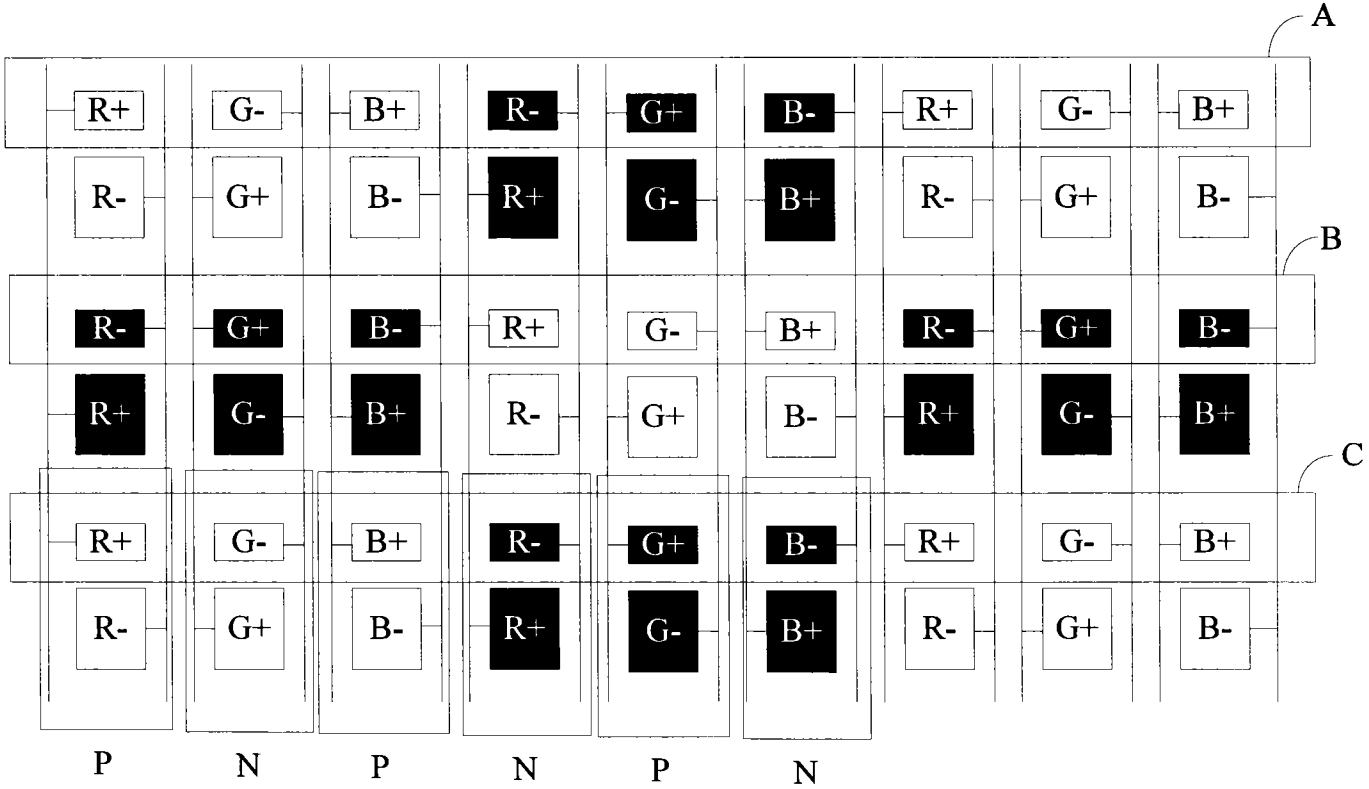
FIG. 1 is a schematic view of a conventional pixel circuit.
Figure 2:
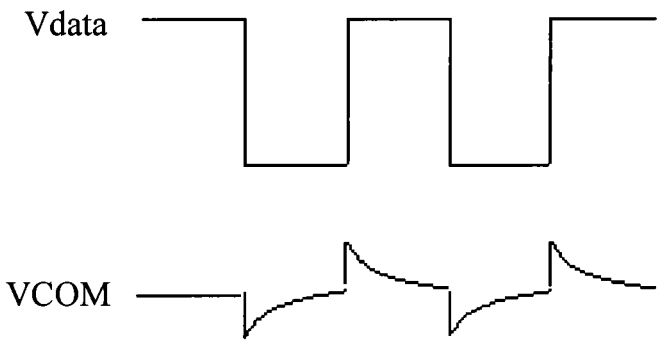
FIG. 2 is a signal waveform of the conventional pixel circuit.
Figure 3:
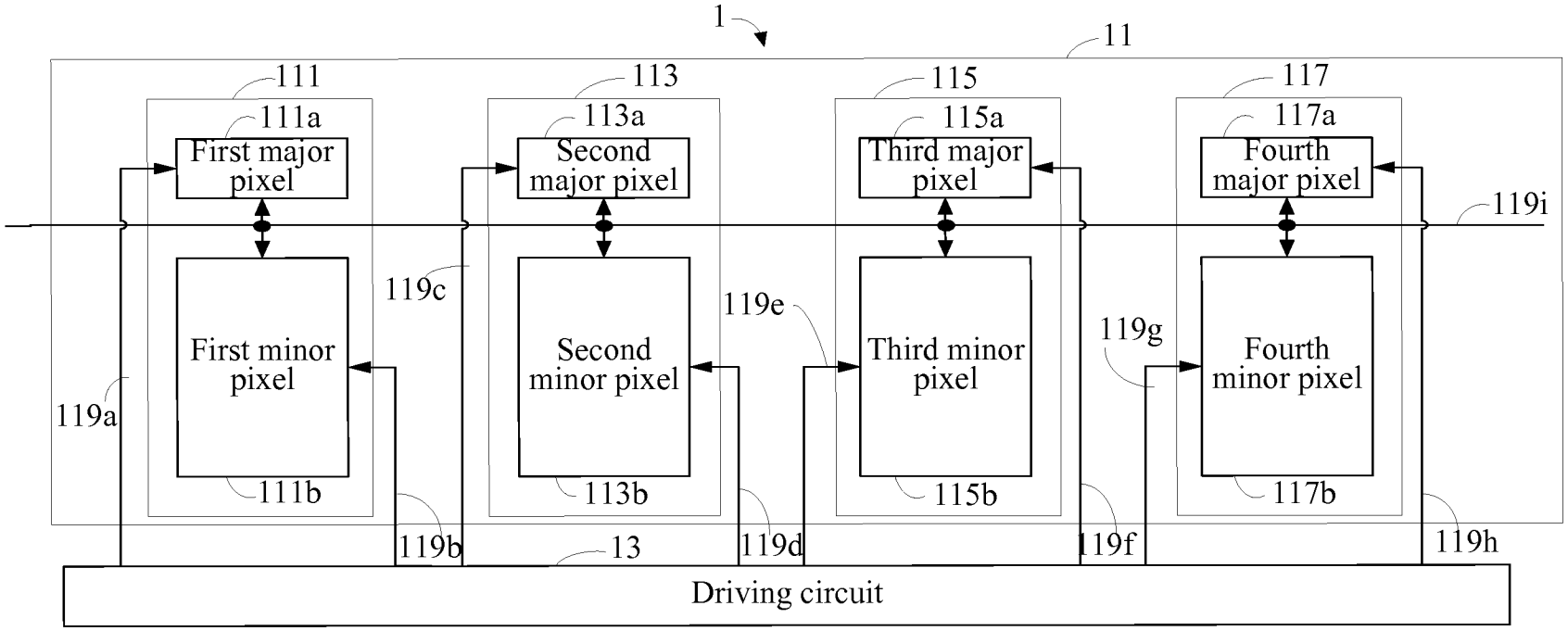
FIG. 3 is a schematic view of a first embodiment of the present invention.

A first embodiment of the present invention is shown in FIG. 3, which is a schematic view of a displayer 1. As can be known from FIG. 3, the displayer 1 comprises a pixel circuit 11 and a driving circuit 13. The pixel circuit 11 belongs to a two data lines and one gate line (2D1G) architecture, and is electrically connected to the driving circuit 13. The driving circuit 13 is configured to provide a driving voltage to the pixel circuit 11 so that the pixel circuit 11 can display a frame in response to the driving voltage.

Specifically, in this embodiment, the pixel circuit 11 comprises a data line set, a gate line set 119*i*, a first pixel electrode 111, a second pixel electrode 113, a third pixel electrode 115 and a fourth pixel electrode 117. The gate line set 119*i* is electrically connected to the first pixel electrode 111, the second pixel electrode 113, the third pixel electrode 115 and the fourth pixel electrode 117 respectively to control conducting states of the pixel electrodes. It shall be noted that, the number of the pixel electrodes comprised in the pixel circuit 11 may be increased or decreased depending on actual applications; and how to implement the present invention with other numbers of pixel electrodes will be readily known by those of ordinary skill in the art based on the description of the present invention, and thus will not be further described herein.

Furthermore, the data line set is electrically connected to the driving circuit 13, the first pixel electrode 111, the second pixel electrode 113, the third pixel electrode 115 and the fourth pixel electrode 117 respectively so that the first pixel electrode 111, the second pixel electrode 113, the third pixel electrode 115 and the fourth pixel electrode 117 can, when being in the conducting state, receive the driving voltage through the data line set.

In this embodiment, a display color of the fourth pixel electrode 117 is the same as display colors of the first pixel electrode 111. A display color of the third pixel 115 electrode is different from the display colors of the first pixel electrode 111 and the second pixel electrode 113. However, the relationship among the display color of each of the pixels described above would be different in the other embodiments, and what described above is not to limit the present invention.

In order to prevent occurrence of the color shift in an image generated by the pixel circuit 11, the first pixel electrode 111, the second pixel electrode 113, the third pixel electrode 115 and the fourth pixel electrode 117 are disposed in the following way in this embodiment. In this embodiment, the first pixel electrode 111 belongs to a same pixel type (e.g., a positive pixel type) as the second pixel electrode 113, and is disposed adjacent to the second pixel electrode 113 as shown in FIG. 3. Furthermore, in this embodiment, the third pixel electrode 115 also belongs to a same pixel type (e.g., a negative pixel type) as the fourth pixel electrode 117; and as shown in FIG. 3, the third pixel electrode 115 is disposed adjacent to the second pixel electrode 113 opposite to the first pixel electrode 111, and the fourth pixel electrode 117 is disposed adjacent to the third pixel electrode 115 opposite to the second pixel electrode 113.

It shall be noted that, in the present invention, the third pixel electrode 115 and the fourth pixel electrode 117 may belong to one of the positive pixel type and the negative pixel type, but must be different from the pixel type to which the first pixel electrode 111 and the second pixel electrode 113 belong. More specifically, when the first pixel electrode 111 and the second pixel electrode 113 belong to the positive pixel type, the third pixel electrode 115 and the fourth pixel electrode 117 must belong to the negative pixel type; otherwise, when the first pixel electrode 111 and the second pixel electrode 113 belong to the negative pixel type, the third pixel electrode 115 and the fourth pixel electrode 117 must belong to the positive pixel type.

As can also be known from FIG. 3, the first pixel electrode 111 comprises a first main-pixel 111*a* and a first sub-pixel 111*b*; the second pixel electrode 113 comprises a second main-pixel 113*a* and a second sub-pixel 113*b*; the third pixel electrode 115 comprises a third main-pixel 115*a* and a third sub-pixel 115*b*; and the fourth pixel electrode 117 comprises a fourth main-pixel 117*a* and a fourth sub-pixel 117*b*. The data line set comprises a first main-pixel data line 119*a*, a first sub-pixel data line 119*b*, a second main-pixel data line 119*c*, a second sub-pixel data line 119*d*, a third main-pixel data line 119*f*, a third sub-pixel data line 119*e*, a fourth main-pixel data line 119*h* and a fourth sub-pixel data line 119*g*.

In this embodiment, a display color of the first main-pixel 111*a* is the same as a display color of the first sub-pixel 111*b* of the first pixel electrode 111. A display color of the second main-pixel 113*a* is the same as a display color of the second sub-pixel 113*b* of the second pixel electrode 113. A display color of the third main-pixel 115*a* is the same as a display color of the third sub-pixel 115*b* of the third pixel electrode 115. A display color of the fourth main-pixel 117*a* is the same as a display color of the fourth sub-pixel 117*b* of the fourth pixel electrode 117. It shall be noted that the descriptions above is one of the preferred practical types of this embodiment, and is not to limit the present invention.

The first main-pixel 111*a* is electrically connected to the first main-pixel data line 119*a*, the first sub-pixel 111*b* is electrically connected to the first sub-pixel data line 119*b*, the second main-pixel 113*a* is electrically connected to the second main-pixel data line 119*c*, the second sub-pixel 113*b* is electrically connected to the second sub-pixel data line 119*d*, the third main-pixel 115*a* is electrically connected to the third main-pixel data line 119*f*, the third sub-pixel 115*b* is electrically connected to the third sub-pixel data line 119*e*, the fourth main-pixel 117*a* is electrically connected to the fourth main-pixel data line 119*h*, and the fourth sub-pixel 117*b* is electrically connected to the fourth sub-pixel data line 119*g*.

As can also be known from FIG. 3, the first sub-pixel data line 119*b* is disposed adjacent to the second main-pixel data line 119*c*, the second sub-pixel data line 119*d* is disposed adjacent to the third sub-pixel data line 119*e*, and the third main-pixel data line 119*f* is disposed adjacent to the fourth sub-pixel data line 119*g*. Through the aforesaid arrangement, the main-pixels and the sub-pixels can, through the data lines connected thereto, receive the driving voltage provided by the driving circuit 13 respectively so as to operate according to the driving voltage.

Furthermore, from the perspective of the circuit layout, each of the first main-pixel data line 119*a*, the second main-pixel data line 119*c*, the third main-pixel data line 119*f* and the fourth main-pixel data line 119*h* may be viewed as a first polarity data line; and each of the first sub-pixel data line 119*b*, the second sub-pixel data line 119*d*, the third sub-pixel data line 119*e* and the fourth sub-pixel data line 119*g* may be viewed as a second polarity data line. In order to effectively reduce the color shift of the display frame, the driving circuit 13 will provide driving voltages of different polarities to each of the main-pixels and its corresponding sub-pixel through the first polarity data line and the second polarity data line respectively.

Specifically, when transmitting a positive driving voltage to the main-pixel 111*a*, the main-pixel 113*a*, the sub-pixel 115*b* and the sub-pixel 117*b* through the first polarity data line, the driving circuit 13 also transmits a negative driving voltage to the sub-pixel 111*b*, the sub-pixel 113*b*, the main-pixel 115*a* and the main-pixel 117*a* through the second polarity data line. In this way of driving, the main-pixels and the sub-pixels of the pixel circuit will be made to present the polarities as shown in FIG. 4.

Figure 4:
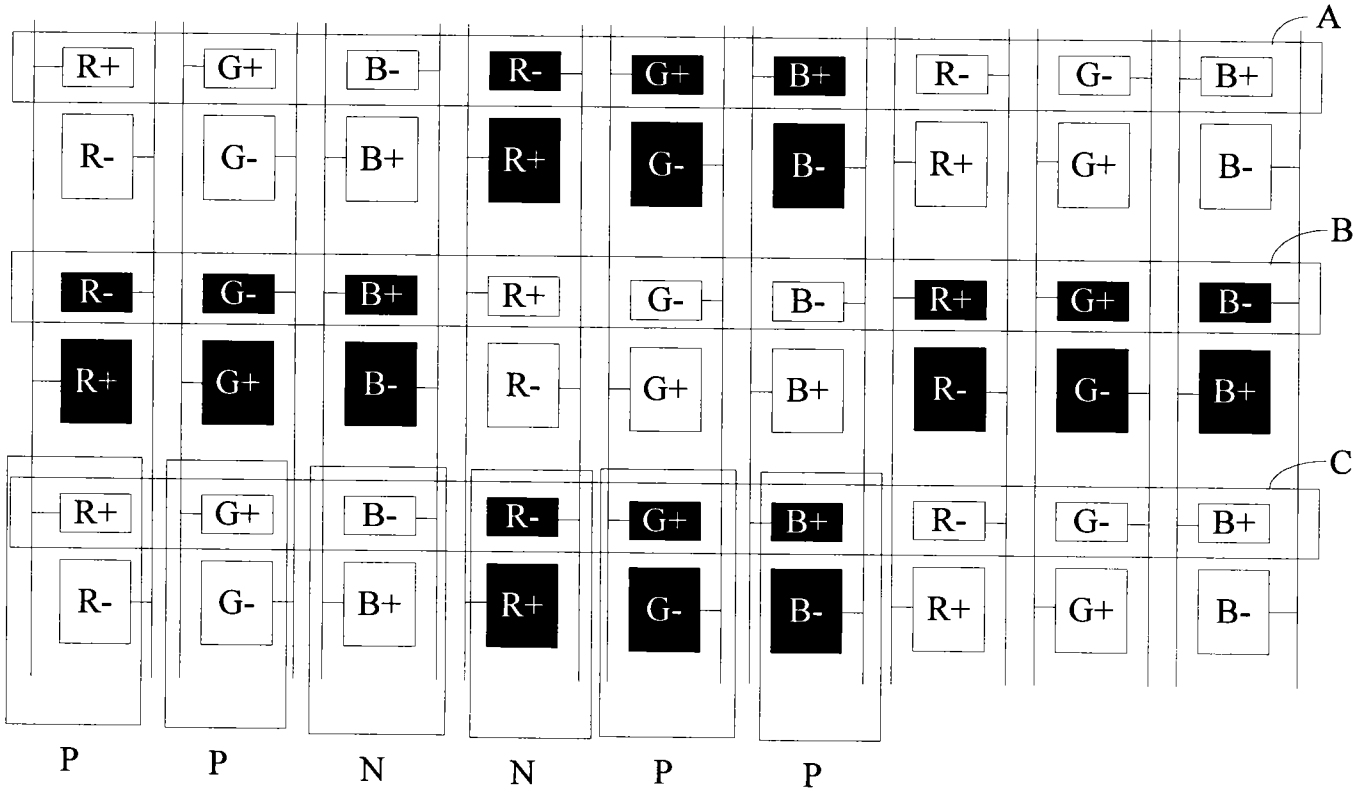
FIG. 4 is a schematic view of a pixel circuit of the first embodiment of the present invention.

Referring to FIG. 4, a schematic view of the pixel circuit is shown therein. In FIG. 4, among the pixel electrodes, R represents a red pixel electrode, G represents a green pixel electrode, B represents a blue pixel electrode, a white background represents that the pixel displays a bright state, and a black background represents that the pixel displays a dark state. As can be known from FIG. 4, in this embodiment, by disposing pixel electrodes belonging to a same pixel type adjacent to each other and providing driving voltages of different polarities, the green main-pixels of the main-pixel rows A, B, C will partly have the positive polarity and partly have the negative polarity and there must be adjacent main-pixels having the same polarity, which is different from the case in the prior art that the green main-pixels of the main-pixel rows A, B, C are all positive and adjacent main-pixels must have different polarities. Therefore, during data transformation, the positive change and the negative change in the waveform of the data can be cancelled out so as to effectively eliminate the phenomenon of biasing to green in the display frame.

In other words, from the perspective of the circuit layout in FIG. 3, in the pixel electrodes comprised in the pixel circuit 11, at least two adjacent pixel electrodes have their main-pixels electrically connected to the first polarity data line respectively, and at least two adjacent pixel electrodes have their sub-pixels electrically connected to the second polarity data line respectively. And among the pixel electrodes, at least two adjacent pixel electrodes have their main-pixels and the sub-pixels electrically connected to the second polarity data line and the first polarity data line respectively. Through this arrangement of the circuit, the color shift of the display frame can be eliminated effectively.

According to the above descriptions, in the present invention, two pixel electrodes belonging to a same pixel type are disposed adjacent to each other. Thereby, during waveform transformation of the driving voltage, the VCOM signal can be effectively prevented from being pulled towards the polarity directions of the red (or blue) main-pixels so that the three colors (i.e., a red color, a green color and a blue color) in the display can conform to the gray scales that are originally defined. This can reduce the color shift of the display frame and increase the added value of this industry.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A pixel circuit of a displayer, the pixel circuit belonging to a two data lines and one gate line (2D1G) architecture, the displayer comprising a driving circuit electrically connected to the pixel circuit and configured to provide a driving voltage to the pixel circuit, the pixel circuit comprising:

a data line set, electrically connected to the driving circuit, and comprising a first data line, a second data line, a third data line, a fourth data line, a fifth data line, a sixth data line, a seventh data line, and an eighth data line;

a first pixel, comprising a first main-pixel and a first sub-pixel, wherein the first main-pixel is electrically connected to the first data line and configured to receive the driving voltage through the first data line while the first main-pixel is in a conducting state, and the first sub-pixel is electrically connected to the second data line and configured to receive the driving voltage through the second data line while the first sub-pixel is in a conducting state;

a second pixel, disposed adjacent to the first pixel, comprising a second main-pixel and a second sub-pixel, wherein the second main-pixel is electrically connected to the third data line and configured to receive the driving voltage through the third data line while the second main-pixel is in a conducting state, and the second sub-pixel is electrically connected to the fourth data line and configured to receive the driving voltage through the fourth data line while the second sub-pixel is in a conducting state;

a third pixel, disposed adjacent to the second pixel opposite to the first pixel, comprising a third main-pixel and a third sub-pixel, wherein the third main-pixel is electrically connected to the sixth data line and configured to receive the driving voltage through the sixth data line while the third main-pixel is in a conducting state, and the third sub-pixel is electrically connected to the fifth data line and configured to receive the driving voltage through the fifth data line while the third sub-pixel is in conducting state;

a fourth pixel, disposed adjacent to the third pixel opposite to the second pixel, comprising a fourth main-pixel and a fourth sub-pixel, wherein the fourth main-pixel is electrically connected to the eighth data line and configured to receive the driving voltage through the eighth data line while the fourth main-pixel is in a conducting state, and the fourth sub-pixel is electrically connected to the seventh data line and configured to receive the driving voltage through the seventh data line while the fourth sub-pixel is in a conducting state;

a fifth pixel, disposed adjacent to the first pixel, comprising a fifth main-pixel and a fifth sub-pixel, wherein the fifth main-pixel is electrically connected to the second data line and configured to receive the driving voltage through the second data line while the fifth main-pixel is in a conducting state, and the fifth sub-pixel is electrically connected to the first data line and configured to receive the driving voltage through the first data line while the fifth sub-pixel is in a conducting state;

a sixth pixel, disposed adjacent to the second pixel and the fifth pixel, comprising a sixth main-pixel and a sixth sub-pixel, wherein the sixth main-pixel is electrically connected to the fourth data line and configured to receive the driving voltage through the fourth data line while the sixth main-pixel is in a conducting state, and the sixth sub-pixel is electrically connected to the third data line and configured to receive the driving voltage through the third data line while the sixth sub-pixel is in a conducting state;

wherein said first pixel, said second pixel, said third pixel, and said fourth pixel are disposed in a first pixel row, and the fifth pixel and the sixth pixel are disposed in a second pixel row directly adjacent to said first pixel row;

wherein the first data line, the second data line, the third data line, the fourth data line, the fifth data line, the sixth data line, the seventh data line, and the eighth data line are disposed sequentially, the first data line, the third data line, the fifth data line, and the seventh data line have a first polarity, the second data line, the fourth data line, the sixth data line, and the eighth data line have a second polarity opposite from said first polarity;

wherein each respective main pixel and subpixel of each pixel have the same horizontal position, and each row of main pixels is separated from the next row of main pixels by a row of sub-pixels.

2. The pixel circuit as claimed in claim 1, wherein the second data line is disposed adjacent to the third data line.

3. The pixel circuit as claimed in claim 1, further comprising a gate line set; wherein the gate line set is electrically connected to the first pixel and the second pixel, and configured to control the conducting states of the first pixel and the second pixel respectively.

4. The pixel circuit as claimed in claim 1, further comprising:

a seventh pixel, disposed adjacent to the fourth pixel opposite to the third pixel said first pixel row, comprising a seventh main-pixel and a seventh sub-pixel, wherein the seventh main-pixel is electrically connected to a ninth data line of said data line set and configured to receive the driving voltage through the ninth data line while the seventh main-pixel is in a conducting state, and the seventh sub-pixel is electrically connected to a tenth data line of said data line set and configured to receive the driving voltage through the tenth data line while the seventh sub-pixel is in conducting state;

an eighth pixel, disposed adjacent to the seventh pixel opposite to the fourth pixel said first pixel row, comprising an eighth main-pixel and a eighth sub-pixel, wherein the eighth main-pixel is electrically connected to an eleventh data line of said data line set and configured to receive the driving voltage through the eleventh data line while the eighth main-pixel is in a conducting state, and the eighth sub-pixel is electrically connected to a twelfth data line of said data line set and configured to receive the driving voltage through the twelfth data line while the eighth sub-pixel is in a conducting state;

wherein said first pixel, said fourth pixel, and said fifth pixel are red, said second pixel, said sixth pixel and said seventh pixel are green, said third pixel and said eighth pixel are blue, said ninth data line and said eleventh data line have said first polarity and said tenth data line and said twelfth data line have said second polarity.

5. The pixel circuit as claimed in claim 4, wherein said first pixel, said second pixel, and said third pixel display a bright state, and said fourth pixel, said fifth pixel, said sixth pixel, said seventh pixel, and said eighth pixel display a dark state.

* * * * *